US006802173B1

(12) United States Patent
Fogle

(10) Patent No.: US 6,802,173 B1
(45) Date of Patent: Oct. 12, 2004

(54) METHOD OF FILLING STRING TRIMMER LINE PACKAGE

(75) Inventor: John R. Fogle, Cave Creek, AZ (US)

(73) Assignee: Robert L. Phillips; part interest ( * ) Notice: Subject to any disclaimer, the term of this patent is extended or adjusted under 35 U.S.C. 154(b) by 0 days.

(21) Appl. No.: 10/417,671

(22) Filed: Apr. 16, 2003

Related U.S. Application Data

(62) Division of application No. 09/894,453, filed on Jun. 28, 2001, now Pat. No. 6,594,972.

(51) Int. Cl.[7] ..... B65B 63/04
(52) U.S. Cl. ..... 53/430
(58) Field of Search ..... 53/469, 430, 435, 53/456, 452, 116, 513; 242/158–178; 206/461, 471, 409, 227, 63.3, 303

(56) References Cited

U.S. PATENT DOCUMENTS 1,076,635 A * 10/1913 Howard ..... 242/588.6
1,154,212 A * 9/1915 Schloss ..... 242/588.3
3,185,299 A * 5/1965 Trainer ..... 206/63.3
3,402,810 A * 9/1968 Percelay ..... 206/461
RE26,493 E * 12/1968 Stoker, Jr. ..... 206/409
3,693,784 A * 9/1972 Holmes ..... 206/409
4,396,165 A * 8/1983 Bates et al. ..... 242/532.6
4,637,516 A * 1/1987 de Roure ..... 206/471
4,643,305 A * 2/1987 De Roure Olivier ..... 206/388
4,650,073 A * 3/1987 Young ..... 206/409
4,974,789 A * 12/1990 Milburn ..... 242/159
5,139,210 A * 8/1992 Schaffer ..... 242/129
6,109,005 A * 8/2000 Fogle ..... 53/430
6,367,629 B1 * 4/2002 Bautista et al. ..... 206/388

* cited by examiner

*Primary Examiner*—Scott A. Smith
*Assistant Examiner*—John Paradiso
(74) *Attorney, Agent, or Firm*—LaValle D. Ptak

(57) ABSTRACT

A thin, flat package of heat sealed thermoplastic material is filled with plastic string trimmer line by inserting a mandrel into an opening in the rear wall of the package to receive the free end of a length of string trimmer line inserted through a slot in the periphery of the package to engage the mandrel. The mandrel is rotated while the package is held in a relatively fixed position to wind line onto the mandrel and, therefore, into the package, until the package is filled. The mandrel then is withdrawn, leaving the free end of the line accessible through the opening in the rear wall, and the other end of the line extends from the slot in the periphery of the package.

9 Claims, 3 Drawing Sheets

METHOD OF FILLING STRING TRIMMER LINE PACKAGE

This application is a division of Ser. No. 09/894,453 filed Jun. 28, 2001 now U.S. Pat. No. 6,594,972.

BACKGROUND

Brush and weed trimming machines, utilizing a cutting element in the form of segments of plastic string trimmer line, are in widespread use. Many of these machines are hand-held machines; and heavier duty machines utilize a motor and rotating string trimmer head mounted on a wheeled carriage. The cutting element in both type of these machines typically is in the form of a length of nylon monofilament line, carried by a rotating head and extending outwardly from the head. Rotating the head at relatively high speeds (4,000 to 10,000 RPM for example), causes the line to strike and sever grass, weeds and brush in the path of the spinning line.

The plastic line which is used in string trimmer machines wears out, breaks, or otherwise becomes depleted during operation of the machine. As a consequence, it is necessary periodically to replenish the line as it is consumed. Many commercial machines, whether they are wheeled machines or hand-held machines, employ cut length segments of line with the line segments entirely replaced once they are worn to a point near the rotating hub on which they are mounted. Many hand-held machines employ a reservoir of coiled line, which is fed out of the reservoir by centrifugal force through what is known as a "bump and feed" mechanism. These machines store a relatively long length of line in the reservoir on the rotating head; and line is fed out through an opening in the head, as needed, when it becomes depleted.

Refill line for string trimmer machines typically has been packaged in relatively long lengths in the form of coils, from which desired lengths of line may be drawn for use in either fixed length string trimmer machines or the bump and feed machines described briefly above. One of the oldest packages for holding string trimmer line (which typically has a diameter of 0.065" to 0.155") is in the form of a rectangular cardboard box with a hole in one of its faces. The line is wound into a coil and then placed immediately into the box. The box then is closed and sealed to contain the line. The inner end of the line is started through the hole, which typically is of a 2" diameter or so. The line is removed by pulling it out of the hole.

Another package for string trimmer line has been made in the form of a donut-like shape with an open slot on the outer circumference. In this package, the two halves are sealed together at their centers (the center of the donut) with a donut or tire-like shape about the center. A slot between the two halves is left in the external circumference of the donut. The line then is either wound into the package by rotating the package after the center has been sealed, or by first winding a coil of the line, placing a temporary retainer on the coil, and then placing the coil between the two halves of the donut, which subsequently are sealed together at the center. Line is removed from this package by rotating the line through the outside diameter of the package.

Another type of package has been formed by providing a generally cylindrically shaped open-face container, which is provided with a lid. The line is wound into a coil and then placed in the container, which then is sealed with a lid with a hole through it. This assembly and the removal of line from this package is very much the same as from the cardboard box package described previously.

Another approach which has been used to package string trimmer line is to form loops of line, which are wound and taped. The taped loops are placed into a blister cup, which then is sealed to a backing. Once again, it should be noted that this technique requires the loops of line first to be wound and taped, and then placed into a package which is sealed around the line after it has been configured to fit into the package.

A different technique is disclosed in the U.S. Pat. No. 6,109,005 to Fogle. In the package of this patent, a bubble or blister of thermoplastic material is heat sealed onto a thermoplastic backing which has a hole in it. Line then is spiral wound into the previously sealed package by means of a winding machine to fill the package with line of the desired total length. Once the desired amount of line has been wound into the package, it is severed. The inside end may be withdrawn through the hole to supply desired lengths of line for replacement in conjunction with string trimmer machines. An advantage of the package shown in the Fogle patent is that the spring pressure of the line in the package is not sufficient to break the thermosealed package apart; so that even line of the larger diameters may be wound in a relatively tight circle into a package of this type without concern that the package subsequently may burst.

The U.S. Pat. No. 1,154,212 to Scloss; Percelay U.S. Pat. No. 3,402,810 and de Roure U.S. Pat. No. 4,637,516 are all directed to dispensing containers for different types of materials. In all of these, however, a coil of material first is formed, then placed inside the package, which is sealed around the coil. In the package of Schloss, the container is used for dispensing flat rolls of fabric tape or the like. In the device of Percelay, a coil of twine is formed; and then it is sealed into the package. Finally, in the package of de Roure, the coil of material is a wound coil of wire tie material. In the packages of all of these patents, the coil is placed into a portion of the package, and the package then is sealed around the coil. The material is drawn from a center coil hole in the package; but in none of the packages of these patents is the material wound into the package after the package has been either partially or completely formed.

The patent to Milburn U.S. Pat. No. 4,974,789 is directed to a dispensing package for a fiber optic cable. This package is a relatively complex configuration having two mating members which are attached together by means of a separator. The mating members have centrally located openings and are adjoined at their mating edges to define a cavity between them. The separator divides the cavity into two different parts; and each of these parts or chambers holds a circularly coiled portion of a cable. The cable passes through the separator; so that opposite ends of the cable exit, respectively, from the central apertures of each of the two mating members. Thus, the cable can be pulled out of the package from opposite sides (of course, by pulling on different ends). The fiber optic cable which is provided in the package is for medical purposes; and the package further is designed to allow sterilization of the package and cable, and also is designed to permit the reinsertion of the cable into the package.

The U.S. Pat. No. 4,396,165 to Bates is directed to a method and apparatus for loading a coil of steel strapping material into a dispensing carton. The carton is in the form of a relatively flat rectangular box. One of the flat surfaces or walls of the carton has a central circular aperture in it.

To fill the carton of Bates, the carton is mounted on a mandrel, which passes through the circular aperture in the carton. The mandrel has a slot in its end; and the leading end of a supply of steel strapping is fed through an open end of the carton (the other three ends or edges being closed) and is inserted into the slot in the end of the mandrel. The mandrel is rotated, and a coil of the steel strapping is wound into the box. When the desired length has been wound into the box, the mandrel is withdrawn, leaving the leading end available for access through the hole. The open side of the box then is closed to seal the carton. Lengths of strap then are withdrawn from the center of the rectangular carton as needed.

It is desirable to provide a package and a method for packaging plastic string trimmer line in a pre-formed sealed package, from which the line can be withdrawn either from the external edge of the package, or from a hole located at its center.

SUMMARY OF THE INVENTION

It is an object of this invention to provide an improved string trimmer line package and method of packaging.

It is another object of this invention to provide an improved relatively flat package for string trimmer line.

It is an additional object of this invention to provide an improved generally flat package for string trimmer line, from which the line may be withdrawn either from the center or from the periphery of the package.

It is a further object of this invention to provide a method for packaging plastic string trimmer line in a sealed, shallow plastic package, with the line being wound inside the package on a mandrel extending through a hole at the center of the package and being drawn from a supply through a slot in the periphery of the package; so that line may be withdrawn from the package either from the slot or from the hole after the package is filled.

In accordance with a more specific embodiment of the invention, plastic string trimmer line is wound into a sealed package in the form of a relatively flat cylinder with front and rear parallel walls separated by a circular band or edge which forms the space between the front and rear walls. An opening is provided through the rear wall on the central axis of the circular band; and a slot is formed through the circular band, between the front and rear walls. A mandrel having a winding surface on it is inserted through the opening in the rear wall into the space between the two walls. The leading end of a supply of plastic string trimmer line is inserted through the slot to engage the mandrel. The mandrel then is rotated to wind the line about the winding surface of the mandrel, within the package, drawing line through the slot as the winding commences. After winding has been completed, the mandrel is removed from the opening, leaving the leading end of the string trimmer line accessible through the opening in the rear wall. The opposite end of the string trimmer line is accessible through the slot in the circular band.

DETAILED DESCRIPTION

Figure 1:
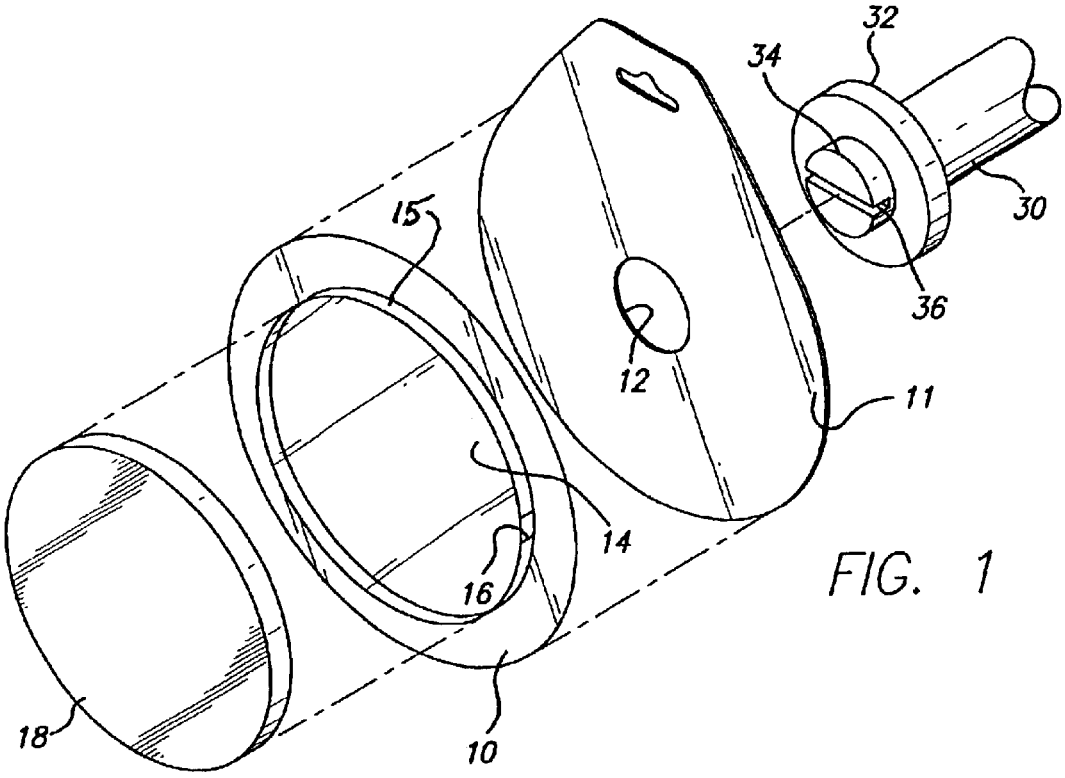
FIG. 1 is an exploded view of various parts of the package and packaging apparatus of a preferred embodiment of the invention.

Reference now should be made to the drawings, in which the same reference numbers are used throughout the different figures to designate the same or similar components. FIG. 1 is an exploded view showing the different parts of a package used in practicing the method of this invention, along with some of the components used in filling the package with plastic string trimmer line in the various diameters commonly used with both commercial and home string trimmer machines.

FIG. 1 is an exploded view of the parts of a package in accordance with the preferred embodiment of the invention, along with an illustration of some of the components which may be used in conjunction with mechanisms for filling the package. As illustrated in FIG. 1, the package consists primarily of a flat rear backing sheet 11 (forming a rear wall) having an opening or hole 12 through its center, along with a front sheet or front surface 14. The sheet or surface 14 is integrally formed of thermoplastic material with a circular band or circumference 15 extending from a flared flange 10. As is most readily apparent from an examination of FIGS. 3, 4, 5 and 6, the flange 10 is bonded to the backing sheet 11 by any suitable manner. The package which is preferred, however, is one made of thermoplastic materials for all of the parts 10, 11, 14 and 15. The flange 10 is heat bonded or thermo-bonded to the backing sheet 11 to form a permanent sealed package. The completed package is in the form of a very short cylinder, the length or height of which is considerably less than the diameter across the circular cross-section or band 15 of the cylinder.

Although a short cylindrical or circular package is shown in the drawings and described in conjunction with a preferred embodiment of the invention, other package shapes also may be used as the full equivalent of the one shown in the drawings. For example, the outer periphery of the sealed package may be a square or a hexagon, or other shape, as well as the circular band as shown in the various figures of the drawing. In the ensuing description, reference to a cylinder or short cylinder is intended to cover these other shapes as well.

The cylinder or circular band 15 has a relatively short slot 16 formed in it between the front sheet or front surface 14 and the flange 10, as shown clearly in FIGS. 1, 2, 3 and 4. Consequently, once the sealed package has been formed it assumes the configuration shown in FIG. 3, with a hole 12 at the axis of the cylinder and a slot 16 on the periphery or circumference 15 of the cylinder. This causes the cylinder or other package shape to be closed-at the front sheet or front surface 14, and to be closed at the rear by the backing sheet 11, with a hole 12 through the backing sheet 11.

In order to fill the package with string trimmer line or similar material, a mandrel 30 having an end portion 34 with a length or depth equal to or slightly less than the space between the sheets 11 and 14 on the ends of the package, is inserted into the hole 12 (which has a diameter greater than the outside diameter of the end 34 of the mandrel). The end of the mandrel 34 is shown with a diametrical slot 36 through it. Radial slots or holes also could be employed as will be understood from the following discussion.

Figure 2:
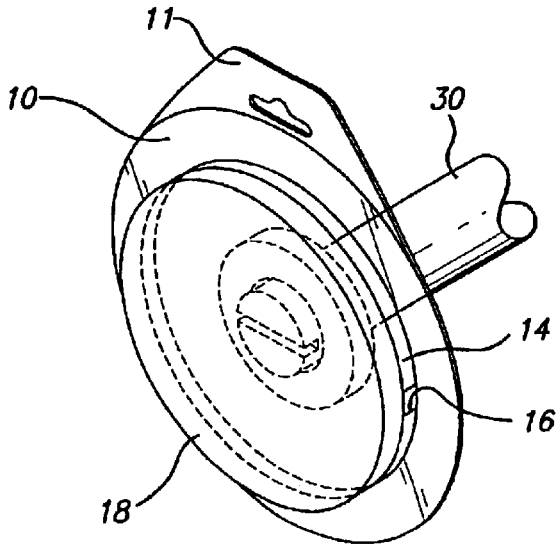
FIG. 2 is an assembled view of the parts shown in FIG. 1.

The mandrel 30 and the head 34 on it are inserted for rotation through a block or plate 32, which is mounted on an apparatus (not shown) to press against the outside surface of the backing sheet 11. On the opposite side of the same apparatus is a plate 18, which presses against the front surface or front sheet 14 of the package to hold the package against rotation, as illustrated in FIG. 2. Since the machine for accomplishing this squeezing or vice type of action may be realized in any number of common configurations, the machine for clamping the package 10, 11, 14, 15 has not been shown in order to avoid cluttering the drawing. It is sufficient to state that when the mandrel 30 is inserted with the end 34 into the interior of the package as illustrated in FIG. 2, the plates 18 and 32 are held in a non-rotational pressure configuration against the package to prevent it from rotating with the rotation of the mandrel.

Figure 3:
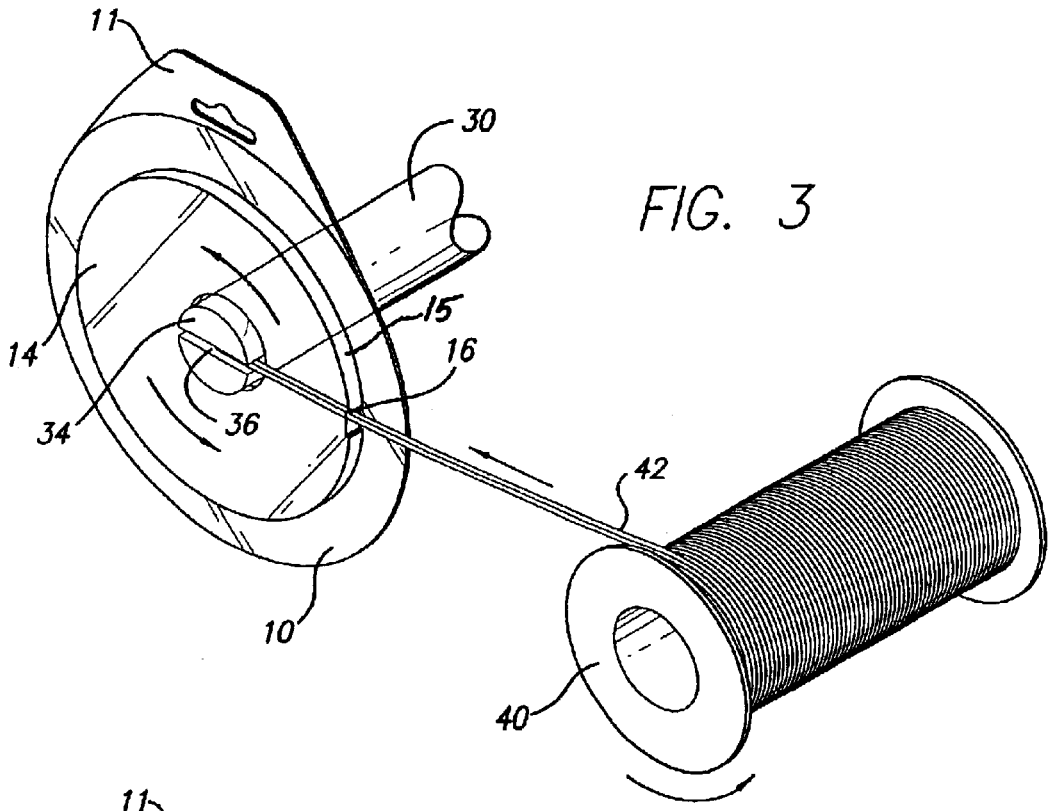
FIG. 3 is a diagrammatic illustration of the manner of beginning the filling of the package shown in FIG. 2.

Once the loading mechanism and the package are assembled in the manner shown in FIG. 2, an end of the supply of string trimmer line 42 is extended from a supply reel 40 through the slot 16 and into the slot 36 of the mandrel, as, illustrated in FIG. 3. After this has been done, the mandrel is rotated in the direction of the arrows shown in FIG. 3 to wind the string trimmer line on the mandrel (and, therefore, upon itself), within the confines of the package, to the configuration which is illustrated in FIG. 4 showing a nearly full package.

Figure 4:
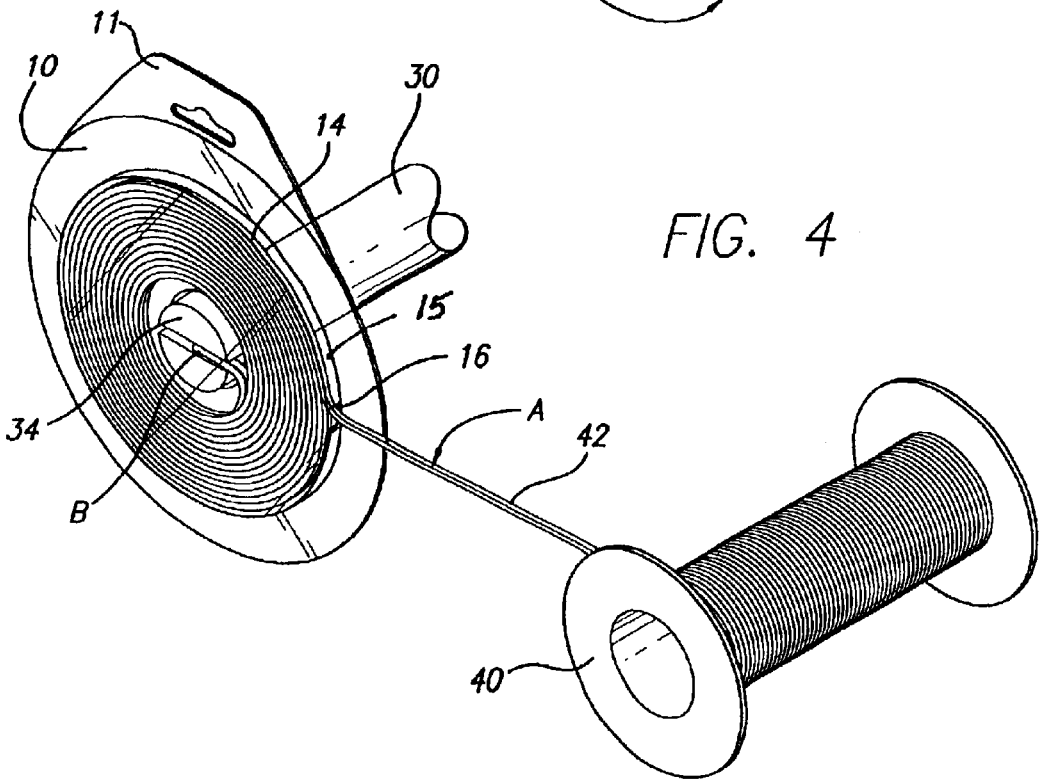
FIG. 4 is a diagrammatic representation of a nearly filled package of the type shown in FIG. 2.
Figure 5:
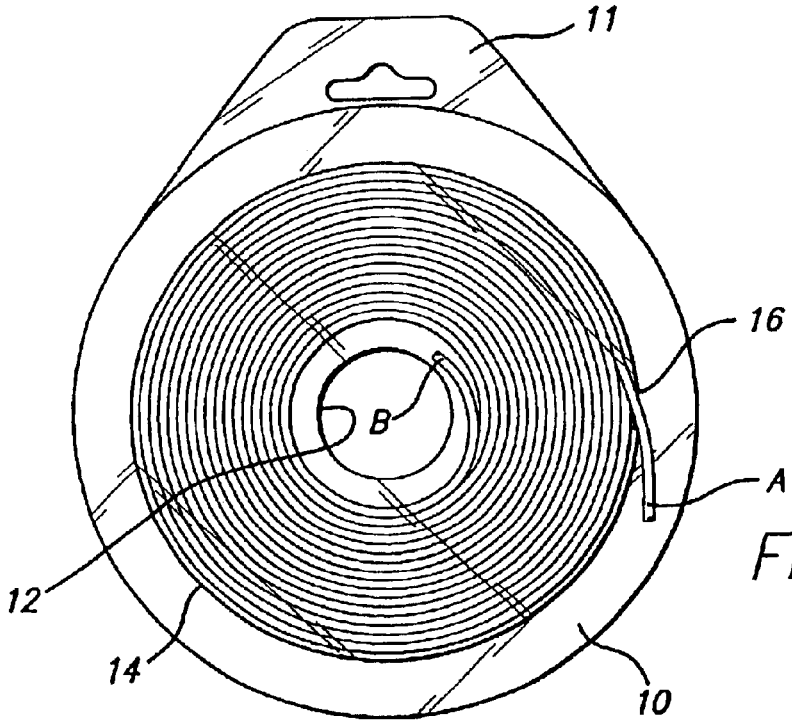
FIG. 5 is a front view of the package of a preferred embodiment of the invention.
Figure 6:
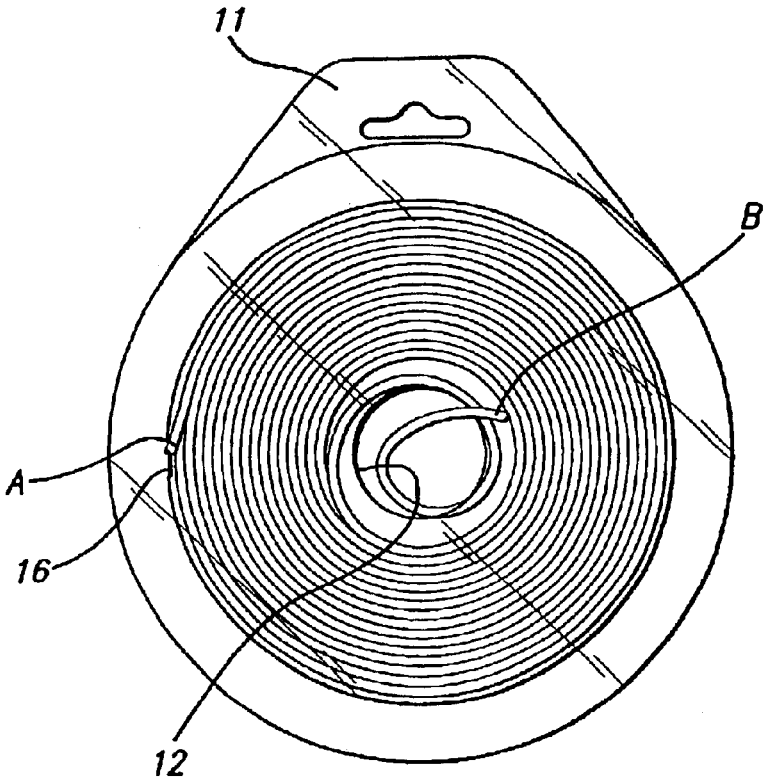
FIG. 6 is a rear view of the package shown in FIG. 5.

Once the package has been filled by withdrawing the line 42 from the reel 40 into the package 10, 11, 14 and 15, the line is cut at the point A shown in FIG. 4 to leave the end A extending out of the slot 16, and the other end B accessible through the hole and: 12 in the wall or backing sheet 11, from which the mandrel is withdrawn. By use of the slotted end on the mandrel, withdrawal of the mandrel simply causes the captured end B of the string trimmer line 42 to be released and available at or extending slightly from the opening or hole 12 of the package. FIGS. 5 and 6 show the front and rear views of the completed package filled with the line, accessible from either ends A or B, from the outer periphery of the package or the center, respectively, as described previously.

It should be noted that in the winding of the package, it is desirable to rotate the package itself a slight amount counterclockwise (as viewed in FIGS. 3 and 4) from the start of the winding as shown in FIG. 3 to the completion of the winding in order to keep the pull point from the reel 40 at the same angle throughout the winding process. This has not been illustrated in conjunction with FIGS. 3 and 4; but typically, the rotation is effected by a slow rotation together of the parts 32 and 18 in an amount of 10° to 15°, depending upon the size of the package in which the trimmer line is being wound.

It also should be noted that configuring the package as illustrated allows the trimmer line to wind in a single layer to form a very flat package. Ideally, such packages are used for providing a "single load" amount of string trimmer line 42. The advantage of such a package is that a significant volume reduction is effected over standard types of packages which have been discussed previously in the background portion of this specification. As illustrated, the line 42 shown in FIGS. 3 and 4 is a side-by-side fused pair where two string trimmer lines of suitable diameter (in the size range described previously) are joined together by a very thin web of material to form a flat pair. Lines of this type are used for some applications of string trimmer line. Consequently, if such a side-by-side line package is desired, the length (or vertical height) of the package established by the band 15 is selected to be just slightly greater than the side-by-side width of the two joined pieces of line. This causes the line to be wound in a single layer upon itself within the package. If only a single line is to be wound, the length or vertical height of the package is selected to be only slightly greater than the single width of line; so that each turn of the mandrel causes a turn of the line in a constant spiral of a single depth to take place within the package. This is the desired form of the package.

It should be noted, however, that although the package is illustrated as forming a single layer of line within it, the length (or vertical height) of the package could be selected to be greater than that of a single line diameter. In such a case, the winding mechanism can be in the form of a traversing spiral wind with the package being moved back-and-forth at a pre-established rate in accordance with the rate at which line is fed into the package to cause an even application of the line on the coil formed on the interior of the package. The preferred form, however, is for a single depth or single layer of line to be formed within the package; and the package dimensions are selected to cause this to take place.

A primary advantage of the package which is formed by the method described above is that the line may be removed from the center of the package, as in accordance with several packages of the prior art, or the line may be removed from the periphery or circumference of the package. It should be noted that if line is taken out from the center of the package through the hole 12, the removal of the line will cause twists to form in it, namely one twist per revolution, since this is inherent if the line is removed from the center. On the other hand, if the line is removed from the outside edge or circumference of the package, it is removed untwisted. If a large package is used, it generally is easier to remove the line through the hole 12 from end B, since there is little friction on this end of the line as it is pulled out of the package. There is more unwinding friction when the line is withdrawn from end A through the slot 16. For packages of relatively small size (of 3" to 4" of loaded line diameter, for example), the line easily may be withdrawn either from the outside edge, or from the center. It is possible to withdraw the line from the outside edge or circumference because it is wound linearly through the slot 16 into the package, making it readily available for withdrawal in the same linear fashion.

Although the above description of a preferred embodiment of the invention is directed to the method and package of a single package unit, the invention may be used to fill more than one package simultaneously. For example, a back-to-back double package may be employed where two of the portions 10/14/15 are bonded on opposite sides of a single backing sheet 11. A hole aligned with the hole 12 then is formed through the front surface or sheet 14 of at least one of the portions 10/14/15 to allow the mandrel end 34 to be inserted through that one portion and through the hole 12 to the other front surface or sheet 14. Line 42 then may be simultaneously wound from separate supplies into both segments of the back-to-back package in the same manner described above. The same principle can be applied to any desired number of packages aligned side by side on a ingle winding mandrel.

The foregoing description of a preferred embodiment of the invention is to be considered as illustrative and not as limiting. For example, although the preferred package has been described in conjunction with thermoplastic material, ideally, transparent material, other materials can be used without departing from the invention. The material which is used needs to form a secure package to withstand the spring forces exerted on it by coiled string trimmer line; but once that requirement has been met, different materials can be employed utilizing the same method and package which has been described above. Various other changes and modifications will occur to those skilled in the art for performing substantially the same function, in substantially the same way, to achieve substantially the same result without departing from the true scope of the invention as defined in the appended claims.

What is claimed is:

1. A method for packaging plastic string trimmer line including the steps of:

forming a sealed package with a front wall and a rear wall parallel to the front wall separated by a circular band with a predetermined circumference to form a space between the front and rear walls;

providing an opening through the rear wall in the center of the circular band;

providing a slot through the circular band between the front and rear walls;

inserting a mandrel having a winding surface through the opening in the rear wall into the space between the front and rear wall;

inserting the leading end of a supply of plastic string trimmer line through the slot and engaging the leading end of the plastic string trimmer line with the mandrel;

rotating the mandrel to wind string trimmer line about the winding surface of the mandrel within the package; and removing the mandrel from the opening in the rear wall, leaving the leading end of the plastic string trimmer line accessible through the opening in the rear wall.

2. The method according to claim 1 further including the step of allowing a portion of string trimmer line to extend outwardly from the slot in the circular band.

3. The method according to claim 2 wherein the step of allowing a portion of the plastic string trimmer line to extend outwardly from the slot in the circular band includes severing the string trimmer line from the supply of string trimmer line.

4. The method according to claim 3 wherein the step of forming a sealed package comprises the provision of a front wall, rear wall and circular band made of thermoplastic material heat sealed together.

5. The method according to claim 4 wherein the space between the front wall and the rear wall is selected to be substantially equal to the width of plastic string trimmer line to be packaged within the sealed package.

6. The method according to claim 5 further including the step of retaining the sealed package in a loading position on the mandrel to substantially prevent rotation of the package with rotation of the mandrel during winding of the line about the winding surface of the mandrel within the package.

7. The method according to claim 1 wherein the step of forming a sealed package comprises the provision of a front wall, rear wall and circular band made of thermoplastic material heat sealed together.

8. The method according to claim 1 wherein the space between the front wall and the rear wall is selected to be substantially equal to the width of plastic string trimmer line to be packaged within the sealed package.

9. The method according to claim 1 further including the step of retaining the sealed package in a loading position on the mandrel to substantially prevent rotation of the package with rotation of the mandrel during winding of the line about the winding surface of the mandrel within the package.

* * * * *